US005947775A

United States Patent [19]

Yamamoto et al.

[11] Patent Number: 5,947,775

[45] Date of Patent: Sep. 7, 1999

[54] CONNECTOR

[75] Inventors: Masaya Yamamoto; Noboru Yamaguchi, both of Shizuoka, Japan

[73] Assignee: Yazaki Corporation, Tokyo, Japan

[21] Appl. No.: 08/848,430

[22] Filed: May 8, 1997

[30] Foreign Application Priority Data

May 29, 1996 [JP] Japan ..... 8-135187

[51] Int. Cl.[6] ..... H01R 13/436

[52] U.S. Cl. ..... 439/752

[58] Field of Search ..... 439/752, 595

[56] References Cited

U.S. PATENT DOCUMENTS 5,460,550 10/1995 Okayasu et al. ..... 439/752
5,647,778 7/1997 Yamaguchi et al. ..... 439/752

FOREIGN PATENT DOCUMENTS 5-36778 5/1993 Japan .

*Primary Examiner*—Gary F. Paumen
*Attorney, Agent, or Firm*—Sughrue, Mion, Zinn, Macpeak & Seas, PLLC

[57] ABSTRACT

A retainer that is arranged selectively in a temporarily retained condition or in a regularly retained condition while slidably fitted into a housing main body in a vertical direction orthogonal to a connector fitting direction. The retainer, blocks the sliding of a terminal protecting cover in an opening direction under the temporarily retained condition, and is set to an inner position from an outer surface of the housing main body. Further, the retainer is inserted into the housing main body deeper under the regularly retained condition than under the temporarily retained condition so as to be set to such a position as to allow the cover to slide in the opening direction.

9 Claims, 6 Drawing Sheets

CONNECTOR

BACKGROUND OF THE INVENTION

1. Field of the Invention

This invention relates to connector structures for connecting wires to printed boards and the like.

2. Background

There has been a connector for printed boards that is inserted into and fitted with a mating case that has a printed board and the like arranged so that electric conduction is established with the printed board.

An example of such a connector, which is disclosed in Unexamined Japanese Utility Model Publication No. Hei. 5-36778, will be described with reference to FIGS. 8A to 9. A connector 100 is constructed in such a manner that a terminal 103 having a wire 105 connected thereto is accommodated in a terminal accommodating chamber 102 formed in a housing main body 101 and that an electric contact piece 104 of the terminal 103 is allowed to be exposed, the electric contact piece 104 being electrically connected with a terminal of a printed board arranged within a hollow portion of a not shown mating case when the connector 100 is inserted into and fitted with the hollow portion of the mating case.

That is, the housing main body 101 is constructed in such a manner that a cover 106 for protecting the electric contact piece 104 is slidably attached to the housing main body. The electric contact piece 104 is exposed by opening the cover 106 at the time of fitting the connector 100.

Further, the connector 100 has a retainer 107 that is releasable from the housing main body 101.

As shown in FIG. 8A, the retainer 107 allows the terminal 103 to be inserted into the terminal accommodating chamber 102 under a temporarily retained condition in which the retainer 107 is slightly floating from the outer surface of the housing main body 101. Further, as shown in FIG. 8B, the retainer 107 has a projection 107*a* that is engageable with the rear end of the terminal 103 under a regularly retained condition in which the retainer 107 has been inserted into the housing main body 101 completely. When the projection 107*a* has been engaged with the terminal 103, the terminal 103 is prevented from coming off from the housing main body 101. Moreover, the retainer 107 has cover moving grooves 108, so that, as shown in FIG. 8C, the cover 106 that is slid by an opening operation at the time of fitting the connector can be accommodated thereinto.

Therefore, in the aforementioned connector 100, if the terminal 103 has been incompletely inserted, the retainer 107 is not brought into the regularly retained condition from the temporarily retained condition with the projection 107*a* interfering with the terminal 103 as shown in FIG. 9, so that the cover moving grooves 108 are not set to predetermined positions. Accordingly, the cover 106 is blocked from sliding in the opening direction, which in turn contributes to detecting incomplete insertion of the terminal 103 satisfactorily.

By the way, during the connector 100 assembling process, the housing main body 101 is transported with the retainer 107 held under the temporarily retained condition, and the terminal 103 is thereafter inserted into the housing main body 101 in the next process. However, in this assembling process, the retainer 107 is transported to the next process while slightly floating from the outer surface of the housing main body 101. Therefore, the retainer 107 is pressed down during the transportation to thereby be brought into the regularly retained condition from the temporarily retained condition easily. Therefore, in the next process, the retainer 107 that is once regularly retained in the housing main body 101 must be brought back to the temporarily retained condition by pulling while keeping such retainer 107 unlocked, and then the terminal must be assembled to the housing. Hence, assembling operability has been impaired.

Further, the retainer 107 is inserted into the opening that has such a shape as to occupy the majority of the rear surface (the right half surface portion shown in the drawings) of the housing main body 101. Therefore, the rigidity of the housing main body 101 has been reduced.

SUMMARY OF THE INVENTION

The present invention has been made in view of the aforementioned circumstances. The object of the present invention is therefore to provide a connector that eliminates the problem of causing the retainer to be brought into the regularly retained condition from the temporarily retained condition unexpectedly, and secures the rigidity of the housing main body, so that terminal assembling operability can be improved.

To achieve the above object, the present invention is applied to a connector allowing terminals within terminal accommodating chambers to be exposed by opening a cover being slidably attached to a housing main body. In such a connector, a retainer is arranged. The retainer is slidably fitted into the housing main body in a vertical direction that is orthogonal to a connector fitting direction, and the retainer is also arranged selectively in a temporarily retained condition or in a regularly retained condition. The temporarily retained condition allows the terminals to be inserted into the terminal accommodating chambers, and the regularly retained condition blocks the terminals from coming off from the terminal accommodating chambers. The retainer blocks the sliding of the cover in an opening direction and is positioned inward from an outer surface of the housing main body under the temporarily retained condition, and further, the retainer allows the cover to slide by an opening operation while positioned below the cover under the regularly retained condition.

The retainer may be designed so as to be turnably coupled to the housing main body through hinges.

The retainer may be formed of a base portion and side walls erecting on both sides of the base portion. The base portion has terminal detecting projections that are engageable with the terminals in the terminal accommodating chambers by entering into the terminal accommodating chambers. The side walls have temporary retaining portions and regular retaining portions that position-regulate the retainer in the temporarily retained condition and in the regularly retained condition while engaged with the housing main body.

According to the thus constructed connector, the retainer is arranged at such an inner position as not to project from the outer surface of the housing main body when fitted into the housing main body under the temporarily retained condition. Therefore, the retainer is not brought into the regularly retained condition unexpectedly during the transportation of the connector, etc. Accordingly, the connector is carried to the next process with the retainer temporarily retained, which in turn allows terminal inserting operation to be performed satisfactorily.

Further, when the retainer is formed so as to be coupled to the housing main body, the number of parts can be reduced, which in turn contributes to curtailing management costs in a manufacturing.

Furthermore, if the retainer is formed compact with a base portion and side walls erecting on both sides of the base portion, the opening of the housing main body that allows the retainer to be fitted thereinto can be downsized, which in turn contributes to securing rigidity of the housing main body.

BRIEF DESCRIPTION OF THE DRAWINGS

FIG. 8A is a sectional view with a terminal being inserted, FIG. 8B is a sectional view with a retainer regularly retained, and FIG. 8C is a sectional view with a cover opened.

DETAILED DESCRIPTION OF THE PREFERRED EMBODIMENT

Figure 1:
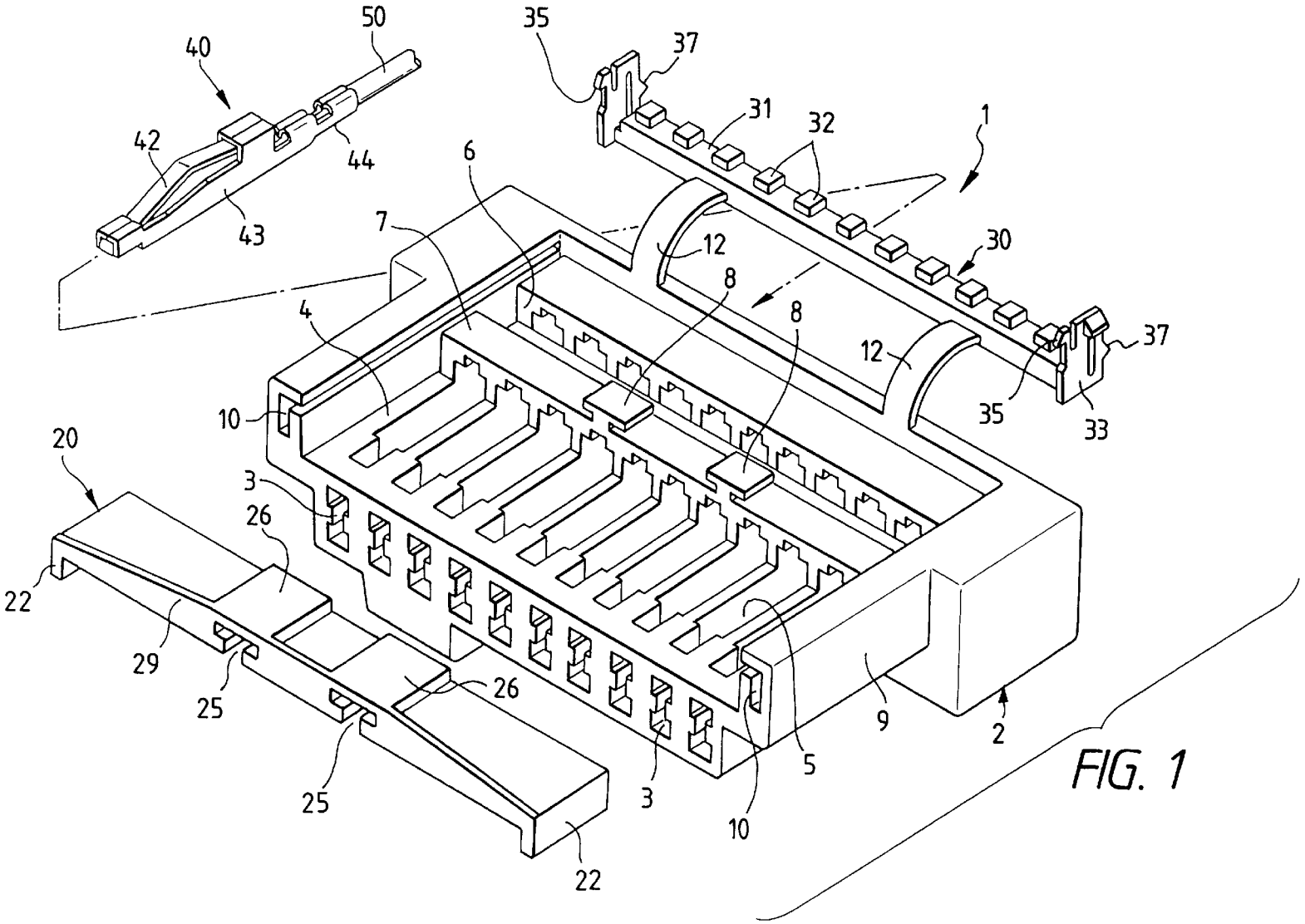
FIG. 1 is an exploded perspective view of a connector, which is a mode of embodiment of the present invention.

Connectors, which are preferred modes of embodiment of the present invention, will now be described in detail with reference to the drawings.

A connector 1 includes: a housing main body 2 made of resin into a box-like form by molding; a terminal protecting cover 20 that is slidably attached to the housing main body 2; a retainer 30 that prevents a terminal from coming off and detects incomplete insertion of a terminal while fitted into the housing main body 2; and a terminal 40 that is assembled into the housing main body 2.

The terminal 40 is formed by blanking an electrically conductive metal sheet, and has an electrically connecting portion 43 that forms an elastic contact piece 42 while bent from the front end toward the middle and an electrically connecting portion 44 that connects a wire 50 thereto by clamping on the rear side.

The housing main body 2 has a plurality of terminal accommodating chambers 3 juxtaposed horizontally and cuts 5 formed in such upper surface 4 positions as to correspond to the terminal accommodating chambers 3. The cuts 5 serve to expose the elastic contact pieces 42 of the terminals 40 accommodated in the terminal accommodating chambers 3.

An engaging hole 6 that allows the retainer 30 to be fitted thereinto is formed on the rear side of the upper surface 4 so as to transverse the respective terminal accommodating chambers 3. A ridge portion 7 whose top is flattened out is formed so as to project from the upper surface 4 of the housing main body 2 on the upper edge of the engaging hole 6. A pair of ribs 8, each has T-shape in cross section, is arranged so as to project from the upper surface of the ridge portion 7.

Further, slide grooves 10, each being angled in cross section, are formed in the inner sides of both left and right side walls 9 of the housing main body 2, respectively. The slide grooves 10, extending in the axial direction of the connector, serve to attach a cover 20 so as to be slidable along the upper surface 4 of the housing main body 2.

Figure 2:
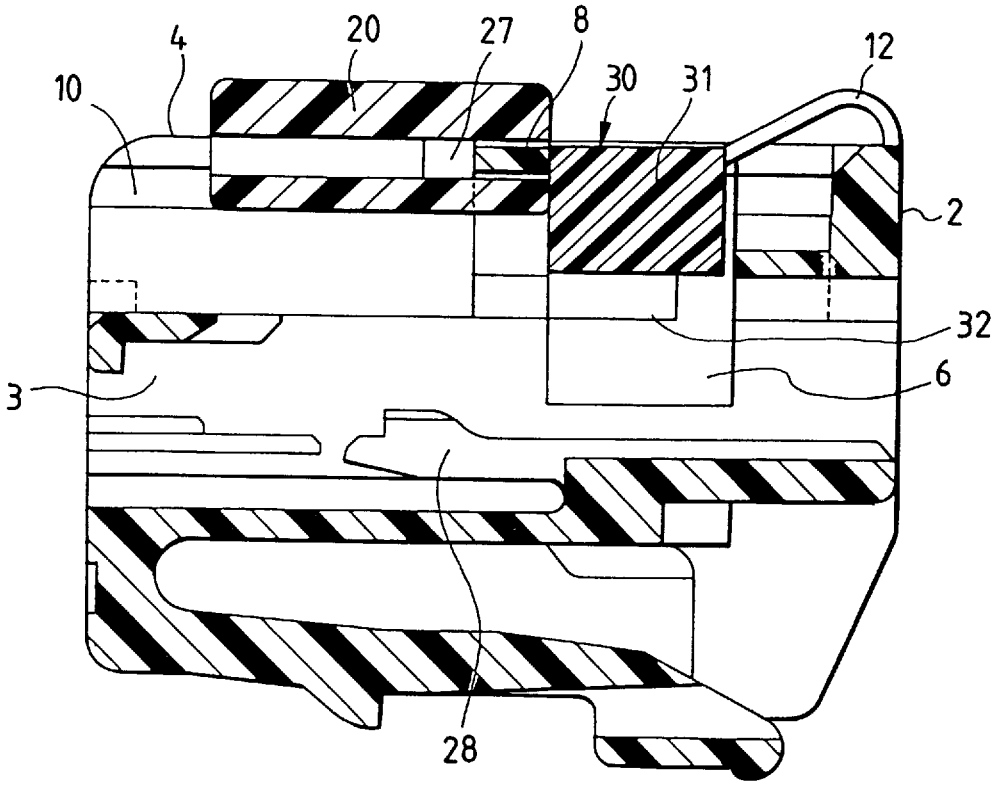
FIG. 2 is a longitudinal sectional view of the connector shown in FIG. 1 with a retainer temporarily retained.
Figure 3:
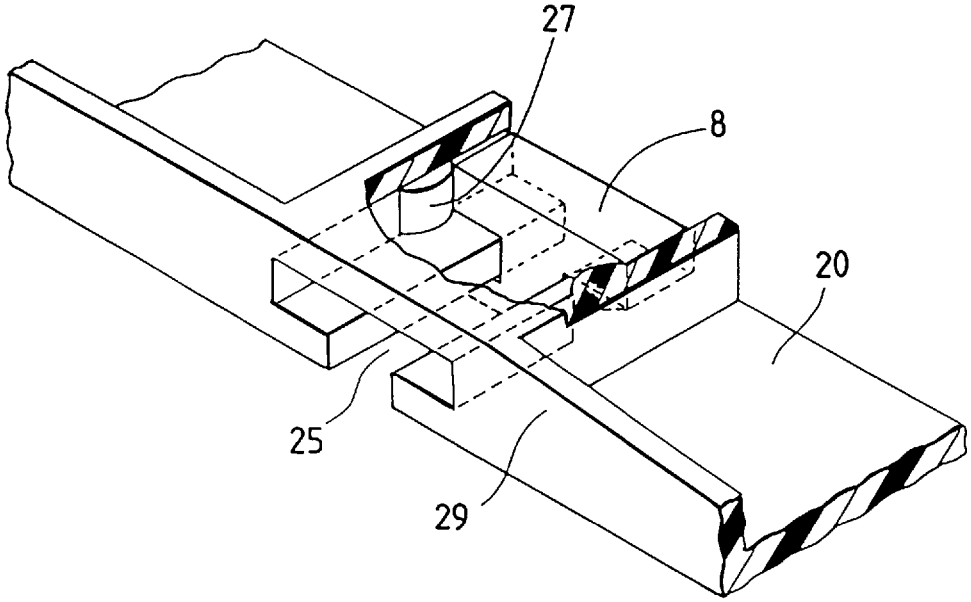
FIG. 3 is a perspective view showing a main portion with part of a cover cutaway.

The cover 20 is arranged so as to be rooflike with both left and right side walls 22 hanging in angled form. By inserting the left and right side walls 22 into the slide grooves 10, the cover 20 can be arranged so as to be slidable almost all along the upper surface 4 of the housing main body 2. Therefore, the cover 20 has engaging projections 26 that allow the T-shaped ribs 8 to be fitted thereinto, respectively. Each engaging projection 26 has an engaging groove 25 whose shape is substantially coincident with the rib 8. As a result of this construction, when the opening operation for exposing the cuts 5 is performed, the cover 20 moves to a position above the engaging hole 6 while passing through the ridge portion 7 that has the ribs 8 projecting therefrom, so that the engaging hole 6 is closed by the cover 20. However, as shown in FIGS. 2 and 3, semi-lock retaining projections 27 project from inner walls of the engaging groove 25, the semi-lock retaining projections 27 confronts the rib 8 so that unexpected movement of the cover 20 can be avoided. Further, the cover 20 has position regulating pieces 23 (see FIGS. 6 and 7) arranged so as to be elastically deformable. Therefore, the cover 20 opening operation is performed in such a manner as to ride over these engaging projections 27 and to release the engagement with the housing main body 2 by elastically deforming the position regulating pieces 23. It may be noted that a reinforcing plate 29 for preventing flexion of the cover 20 is arranged on the front surface of the cover 20.

The retainer 30 that is integrally coupled to the housing main body 2 through hinges 12 is arranged on the rear end portion of the housing main body 2. The retainer 30 is formed so as to be turnable and is fitted into the engaging hole 6 so as to be slidable in a vertical direction that is orthogonal to a connector fitting direction. The retainer 30 is arranged selectively in a temporary retained condition or in a regularly retained condition, both conditions being described later. The retainer 30 has a substantially rectangular base portion 31 and side walls 33 erecting integrally on both sides of the base portion 31. The base portion 31 has terminal detecting projections 32 formed so as to project from the upper surface of the base portion 31 as many as the number of terminal accommodating chambers 3. Each terminal detecting projection 32 is engageable with a terminal 40 within the corresponding terminal accommodating chamber 3 by entering into the terminal accommodating chamber 3 from the engaging hole 6.

On each side wall 33 are a temporary retaining catch 35 and a regular retaining catch 37. The temporary retaining catch 35 serves as a temporarily retaining member for position-regulating the retainer 30 to the temporarily retained condition shown in FIG. 2 by engaging the retainer 30 with the housing main body 2. The regular retaining catch 37 serves as a regularly retaining member for position-regulating the retainer 30 to the regularly retained condition, which will be described later.

Figure 4:
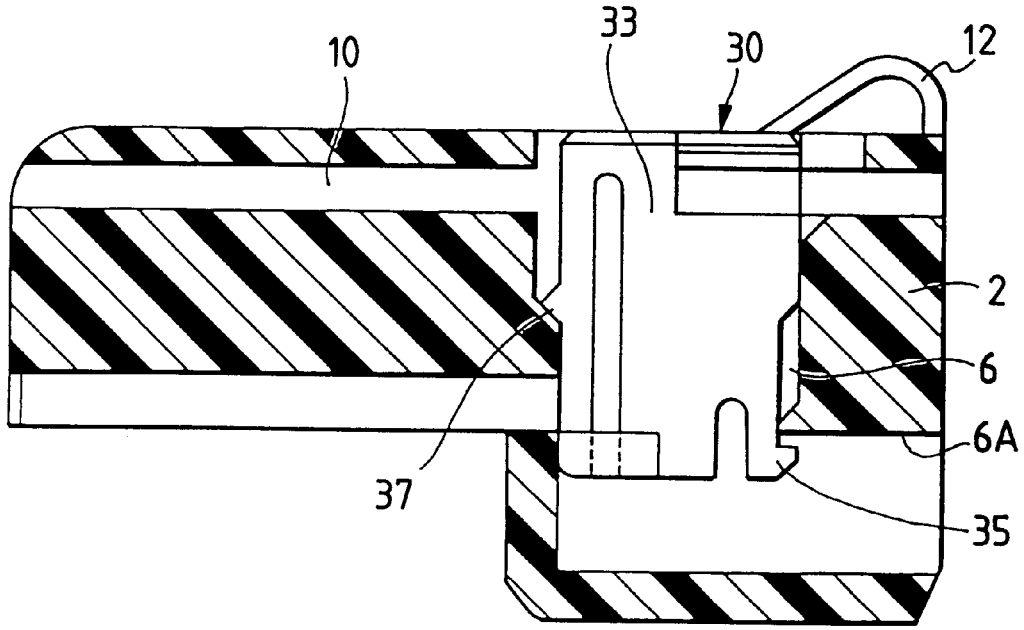
FIG. 4 is a longitudinal sectional view showing a main portion of a condition of a side wall with the retainer temporarily retained.

As shown in FIG. 2, in the temporarily retained condition of the retainer 30, the retainer 30 is arranged at such a position as not to project itself from the outer surface (the upper surface 4) of the housing main body 2 while fitted into the engaging hole 6 and at such a position as to block the sliding of the cover 20 in the opening direction, and the retainer 30 is arranged at such a position as not to allow the projections 32 to enter into the corresponding terminal accommodating chambers 3 so that the terminal accommodating chambers 3 are ready to have terminals 40 inserted thereinto. As shown in FIG. 4, under this condition, the retainer 30 has the temporary retaining catches 35 engaged with lower edge portions 6A of the engaging hole 6 so as to be unreleasable therefrom.

Figure 5:
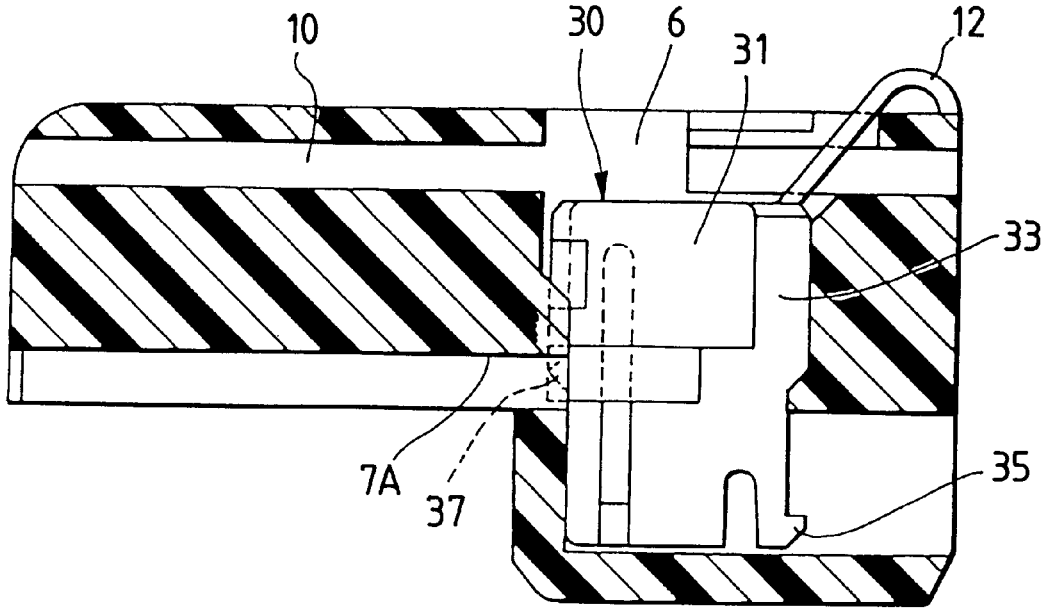
FIG. 5 is a longitudinal sectional view showing a main portion of a condition of the side wall with the retainer regularly retained.

On the other hand, in the regularly retained condition of the retainer 30, when the retainer 30 is further pushed into the housing main body 2 from the temporary retaining condition, the retainer 30 opens the slide grooves 10 to thereby allow the cover 20 to slide in the opening direction as shown in FIG. 5. As a result, the terminals 40 are prevented from being released from the terminal accommodating chambers 3 (see FIG. 7). Under this condition, the retainer 30 has the regular retaining catches 37 engaged with lower surfaces 7A of the ridge portion 7 as shown in FIG. 5.

Figure 6:
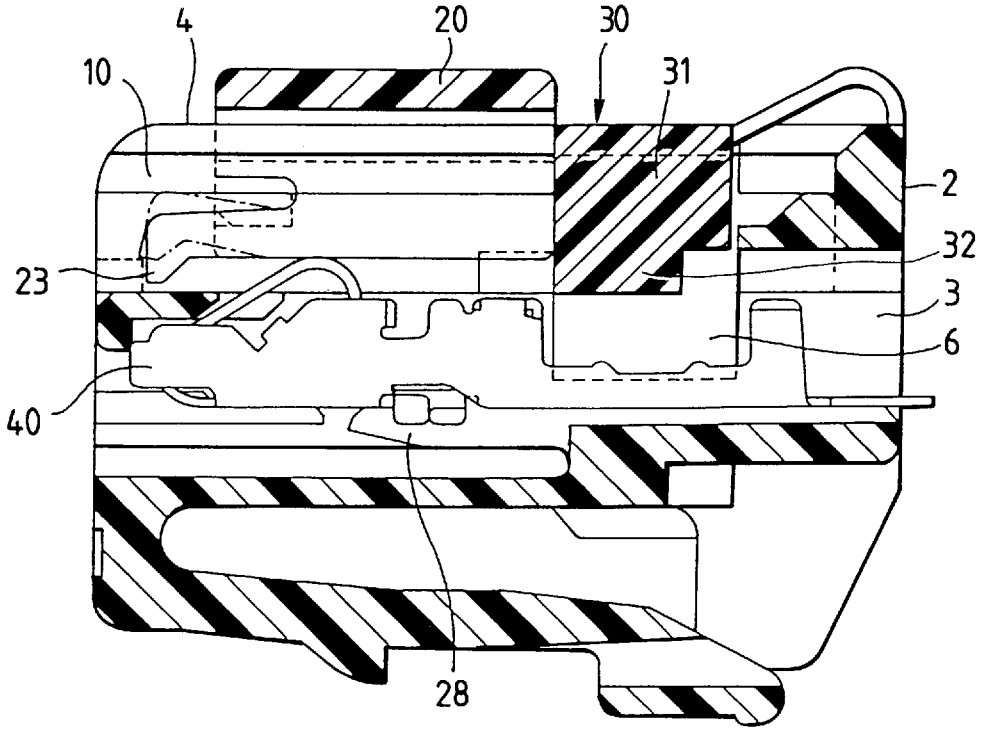
FIG. 6 is a longitudinal sectional view of a connector in a temporarily retained condition for showing a connector assembling procedure of the present invention.
Figure 7:
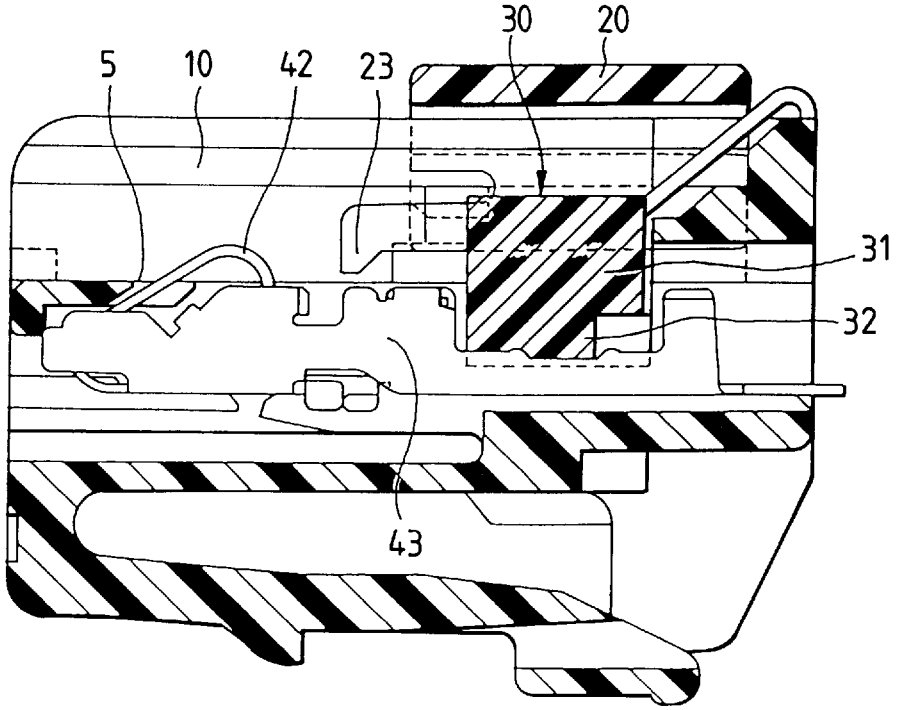
FIG. 7 is a longitudinal sectional view of the connector in a regularly retained condition for showing the connector assembling procedure of the present invention.
Figure 8A:
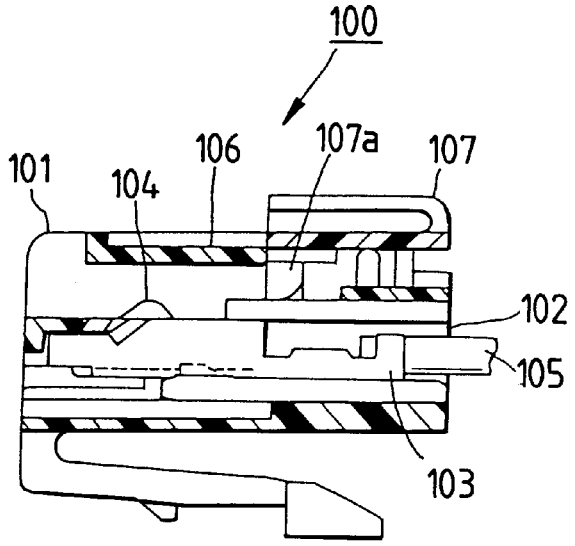
FIG. 8A PRIOR ART
FIGS. 8A to 8C show a conventional example of a connector.
Figure 8B:
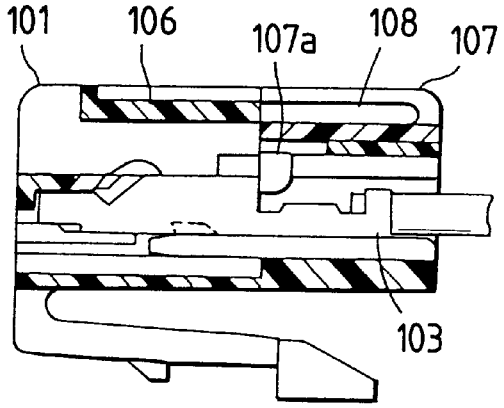
FIG. 8B PRIOR ART
Figure 8C:
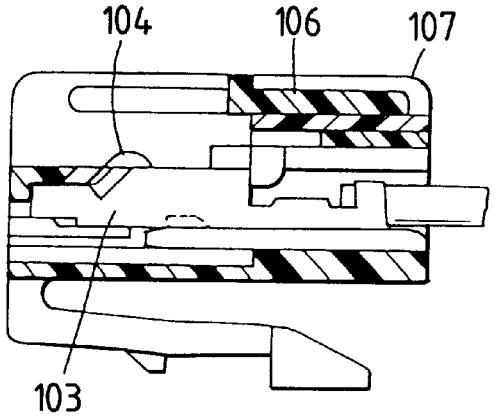
FIG. 8C PRIOR ART
Figure 9:
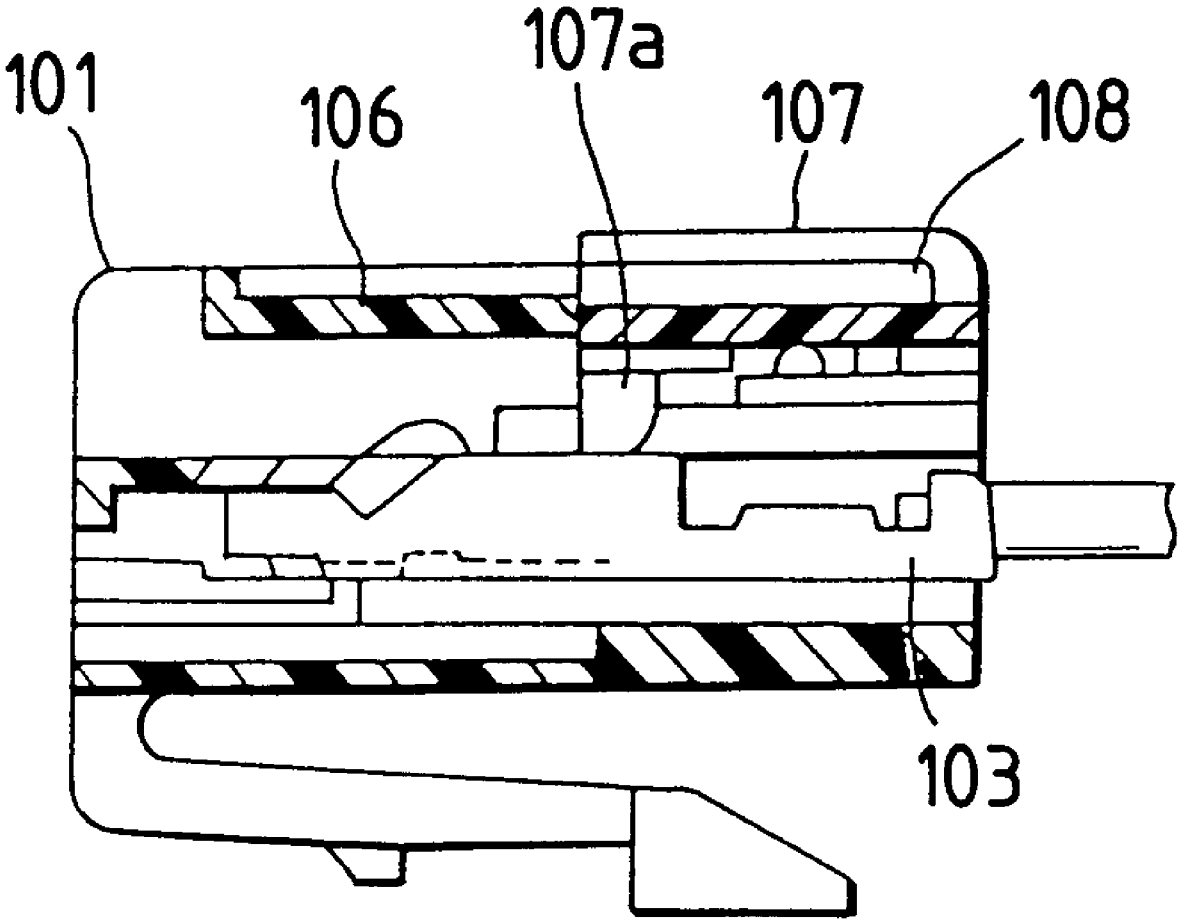
FIG. 9 PRIOR ART
FIG. 9 is a sectional view of the connector in FIGS. 8A to 8C with the terminal incompletely inserted.

Then, an operation of the aforementioned connector 1 will be described in accordance with an assembling procedure. Reference is made to FIGS. 6 and 7.

First, the left and right side walls 22 of the cover 20 are inserted into the slide grooves 10, so that the cover 20 is set to such a position on the upper surface 4 as to cover the cuts 5 of the housing main body 2. It may be noted that under this condition, the retaining projections 27 of the cover 20 come in contact with the ribs 8 and the position regulating pieces 23 engage with the housing main body 2, so that the cover 20 is position-regulated by the housing main body 2. Then, the retainer 30 is fitted into the engaging hole 6 from above the housing main body 2 while deforming the hinges 12, and the temporary retaining catches 35 engage with the lower edge portions 6A of the engaging hole 6, so that the retainer 30 is temporarily retained. The retainer 30 is transported to the next process under this condition. In the next process, terminals 40 with wires connected thereto are ready to be inserted into the corresponding terminal accommodating chambers 3. Therefore, as shown in FIG. 6, the terminals 40 are inserted into the corresponding terminal accommodating chambers 3 as far as to the correct positions, and flexible retaining pieces 28 (see FIG. 2) are engaged into the terminals 40 so as to be unreleasable therefrom. Then, when the retainer 30 is pushed down from above and inserted deeply into the housing main body 2 so that the retainer 30 can be regularly retained, the terminal detecting projections 32 are set at the rear ends of the electrically connecting portions 43 of the respective terminals 40 as shown in FIG. 7. Accordingly, the terminals 40 are doubly retained so as to be unreleasable, and at the same time, the slide grooves 10 are opened so that the cover 20 can be slid in the opening direction. Therefore, when the cover 20 is moved above the retainer 30, the terminals 40 are exposed outside with the elastic contact pieces thereof 42 projecting from the corresponding cuts 5. Then, the connector 1 is inserted into and fitted with a hollow portion of a not shown mating case, so that the elastic contact pieces 42 come in slidable contact with the contact terminals of a printed board arranged in the hollow portion of the mating case. As a result, electric conduction is established.

That is, the connector 1 according to this mode of embodiment is designed so that the retainer 30 does not project from the upper surface 4 of the housing main body 2 when the retainer 30 is transported to the next process under the temporarily retained condition. Therefore, the retainer 30 is in no way brought into the regularly retained condition unexpectedly during transportation, and thus the retainer 30 does in no way prevent the terminals 40 from being attached to the connector 1 thereafter. As a result, assembling operation is not made complicated.

If a terminal 40 is inserted into a terminal accommodating chamber 3 incompletely during the series of aforementioned processes, the corresponding terminal, detecting projection 32 collides with the electrically connecting portion 43 of the terminal 40 when the retainer 30 is brought into the regularly retained condition, which in turn hampers the retainer 30 from being regularly retained. In addition, the cover 20 collides with the retainer 30, which in turn blocks the cover 20 from sliding. Therefore, should there be a mere single incompletely inserted terminal 40, the cover 20 can detect such incomplete insertion of the terminal 40. Since the cover 20 is designed so that flexion thereof is strongly blocked by the function of the reinforcing plate 29 and the engagement of the cover 20 with the ribs 8, the cover 20 does in no way allow itself to be opened while flexing itself by force to ride over the retainer 30 under the presence of an incompletely inserted terminal 40.

While the retainer 30 is formed integrally with the housing main body 2 in the aforementioned mode of embodiment, the retainer 30 may be a separate piece from the housing main body 2 in the present invention. However, the integral design is advantageous since the number of parts can be reduced and management cost can hence be curtailed.

As described in the foregoing in detail, the connector of the present invention allows the retainer to be transported to the next process in the temporarily retained condition in which the retainer does not project from the outer surface of the housing main body. Therefore, terminal inserting operation can be started immediately after the arrival of the connector at the next process, and such inserting operation can be performed satisfactorily.

Further, if the retainer is formed integrally with the housing main body, the number of parts can be reduced, which in turn contributes to curtailing management costs in a manufacturing.

Further, the retainer can be formed compact with a base portion and side walls erecting on both sides of the base portion. Therefore, the engaging hole of the housing main body for allowing the retainer to be fitted thereinto can be downsized as well to thereby prevent reduction in the rigidity of the housing main body.

What is claimed is:

1. A connector, comprising:

a housing including a plurality of terminal accommodating chambers for receiving terminals, said terminals having exposed portions which are exposed from said terminal accommodating chambers, respectively;

a retainer slidably fitted into said housing in a vertical direction to a connector fitting direction, said retainer being arrangeable selectively in one of a temporarily retained condition and a regularly retained condition, the temporarily retained condition allowing the terminals to be inserted into said terminal accommodating chambers, the regularly retained condition blocking said terminals from being removed from said terminal accommodating chambers; and a cover member slidably attached to said housing to cover said exposed portions of said terminals, wherein when said retainer is in the temporarily retained condition, said retainer blocks the sliding of said cover member in an opening direction and is positioned inward from the outer surface of said housing, and wherein when said retainer is in the regularly retained condition, said retainer allows said cover member to slide while said retainer is positioned below said cover member.

2. The connector of claim 1, further comprising hinges formed between said housing and said retainer, wherein said retainer is pivotally disposed on said housing by said hinges.

3. The connector of claim 1, wherein said retainer includes:

a base portion having terminal detecting projections being engageable with said terminals in said terminal accommodating chambers by entering into said terminal accommodating chambers; and side walls on both sides of said base portion, said side walls respectively having temporary retaining portions and regular retaining portions engaged with said housing to maintain said retainer in the temporarily retained condition and in the regularly retained condition.

4. The connector of claim 3, further comprising an engaging hole formed through said terminal accommodating chambers, wherein said retainer slidably fitted into said engaging hole.

5. The connector of claim 4, wherein said terminal accommodating chambers are divided by said engaging hole into a first section and a second section, and wherein said temporary retaining portions engage with lower portions of said first section in the temporarily retained condition, and said regular retaining portions engage with lower portions of said second section in the regularly retained condition.

6. The connector of claim 1, further comprising:

a ridge portion formed in said housing, said ridge portion having a rib formed thereon; and an engaging groove formed in said cover member, said engaging groove engaging with said rib when said cover member is attached to said housing.

7. The connector of claim 6, wherein said rib has a T-shape, and said engaging groove has a T-shape.

8. The connector of claim 1, further comprising:

slide grooves formed in inner side walls of said housing, respectively; and side walls formed on both sides of said cover member, said side walls respectively inserted into said slide grooves when said cover member is attached to said housing.

9. The connector of claim 1, further comprising an engaging hole formed through said terminal accommodating chambers, wherein said retainer slidably fits into said engaging hole.

* * * * *